US007533891B2

(12) United States Patent
Orr et al.

(10) Patent No.: US 7,533,891 B2
(45) Date of Patent: May 19, 2009

(54) RECREATIONAL BINDING WITH ADJUSTABLE SUSPENSION INTERFACE

(75) Inventors: Keith M. Orr, Boston, MA (US); Gordon Hay, Stowe, VT (US); Edward Kunkel, Newton, MA (US)

(73) Assignee: Bivab, LLC., Marblehead, MA (US)

( * ) Notice: Subject to any disclaimer, the term of this patent is extended or adjusted under 35 U.S.C. 154(b) by 0 days.

(21) Appl. No.: 11/511,013

(22) Filed: Aug. 28, 2006

(65) Prior Publication Data

US 2006/0290106 A1 Dec. 28, 2006

Related U.S. Application Data

(62) Division of application No. 10/608,852, filed on Jun. 27, 2003, now Pat. No. 7,097,195.

(51) Int. Cl.
*A63C 9/00* (2006.01)

(52) U.S. Cl. ..... 280/14.24; 280/626; 280/628; 280/629; 280/14.22

(58) Field of Classification Search ..... 280/620, 280/626, 628, 629, 617, 14.24, 14.22, 11.27, 280/11.28

See application file for complete search history.

(56) References Cited

U.S. PATENT DOCUMENTS

| | | | |
|---|---|---|---|
| 2,719,725 | A | 10/1955 | Ware |
| 2,955,300 | A | 10/1960 | Hedlund et al. |
| 3,917,298 | A | 11/1975 | Haff |
| 4,740,804 | A | 4/1988 | Shands |
| 4,741,550 | A | 5/1988 | Dennis |
| 5,092,621 | A | 3/1992 | Horn |
| 5,188,386 | A | 2/1993 | Schweizer |
| 5,577,755 | A | 11/1996 | Metzger et al. |
| 5,803,467 | A | 9/1998 | Piotrowski |
| 5,813,688 | A | 9/1998 | Dacklin |
| 5,826,910 | A | 10/1998 | Ricks et al. |
| 5,876,045 | A | 3/1999 | Acuna, Jr. |
| 5,890,729 | A | 4/1999 | Bayer et al. |
| 5,915,718 | A | 6/1999 | Dodge |
| 5,947,508 | A | 9/1999 | Graf et al. |
| 5,971,419 | A | 10/1999 | Knapschafer |

(Continued)

*Primary Examiner*—Christopher P Ellis
*Assistant Examiner*—Katy Meyer
(74) *Attorney, Agent, or Firm*—Davis & Bujold, P.L.L.C.

(57) ABSTRACT

A binding system is provided that is effective for use on recreational device, such as a snowboard, and that is adapted to mate to, or that includes, a boot or other footwear worn by the user. In general, the binding system includes a base plate for support a rider's foot, and a connecting element for mating the base plate to an elongate board, e.g., a snowboard. The connecting element is effective to mate the base plate to a snowboard about a fixed central axis and to allow pivotal movement of the base plate about the central axis with respect to the snowboard. The binding system can also include at least one compression member mated to the base plate and/or to a snowboard. The compression member(s) are effective to compress between the base plate and the snowboard in response to a force applied to at least one of the base plate and the snowboard. The binding system is particularly advantageous in that the compression members provide enhanced biomechanical operation, absorbing chatter and shock, and increasing mobility. Moreover, there is no relative motion between the base plate and the boot, so the rider's ability to control the snowboard is not adversely affected.

1 Claim, 7 Drawing Sheets

U.S. PATENT DOCUMENTS

| | | | | |
|---|---|---|---|---|
| 5,984,325 | A | 11/1999 | Acuna | |
| 6,113,114 | A | 9/2000 | Zemke et al. | |
| 6,182,987 | B1 | 2/2001 | Bryant | |
| 6,283,492 | B1 | 9/2001 | Hale | |
| 6,293,578 | B1 | 9/2001 | Anderson et al. | |
| 6,296,258 | B2 | 10/2001 | Higgins et al. | |
| 6,318,749 | B1 | 11/2001 | Eglitis et al. | |
| 6,428,032 | B1 | 8/2002 | Humbel | |
| 6,450,525 | B2 | 9/2002 | Reuss et al. | |
| 6,467,794 | B1 | 10/2002 | De France | |
| 6,491,310 | B1 | 12/2002 | Work | |
| 6,575,489 | B1 | 6/2003 | White | |
| 6,655,700 | B1 | 12/2003 | Caputo et al. | |
| 6,676,152 | B2 | 1/2004 | Gonthier | |
| 6,767,313 | B2 | 7/2004 | Sayce | |
| 6,834,881 | B2 | 12/2004 | Mash | |
| 7,063,346 | B2 * | 6/2006 | Elkington | 280/618 |
| 7,097,195 | B2 * | 8/2006 | Orr et al. | 280/628 |
| 7,178,821 | B2 * | 2/2007 | Miller et al. | 280/624 |
| 2006/0290105 | A1 * | 12/2006 | Coing | 280/617 |
| 2007/0013165 | A1 * | 1/2007 | Panzeri | 280/618 |

* cited by examiner

RECREATIONAL BINDING WITH ADJUSTABLE SUSPENSION INTERFACE

FIELD OF THE INVENTION

The present invention relates to a biomechanical binding for use with a recreational device, and in particular to a snowboard binding having an adjustable suspension interface.

BACKGROUND OF THE INVENTION

Snowboarding has become increasingly popular in recent years and generally involves descending a slope by standing sideways on a lightweight board that is attached to the user's feet. Unlike skiing, which requires the user to shift their weight from one ski to the other, snowboarders shift their weight from heels (heelside) to toes as well as from one end of the board to the other. Shifting weight toward the nose (front) of the board will allow the rider to head downhill, while shifting weight toward the tail (back) of the board will allow the rider to head uphill or slow down. Quick turns can be achieved by pushing the back foot forward or pulling it backward to change direction, and stops can be achieved by pushing heels or toes down hard to dig the edge of the snowboard into the snow.

In order to maneuver the board, the rider's foot must be firmly attached to the board. Currently, snowboarding equipment requires a board, typically around five feet long, bindings attached to the board, and boots. The bindings, which are used to hold the boots to the board, are available in a variety of configurations, including metal fasteners, plastic straps, and step-in versions. Some bindings have high backs behind the heels to provide support and added leverage on turns. Regardless of the type of binding, the bindings typically remain within a fixed orientation during use. Thus, while the snowboard itself can be designed to provide some flexibility, most of the mechanical stress caused by use is placed on the rider. Such stress on the rider's legs can reduce performance, and can cause shearing between the boot and the rider's foot internal to the boot. Moreover, the lack of impact absorption can increase edge chatter and reducer rider control.

Accordingly, there is a need for an improved binding system that reduces stress on the rider's legs, while improving the rider's ability to control the board.

SUMMARY OF THE INVENTION

In general, the present invention provides a binding system for mounting a rider's foot to a recreational riding device to provide an adjustable suspension interface between the rider's foot and the riding device. In one embodiment, the binding system includes a base plate having an upper surface adapted to support the rider's foot, and an opposed, lower surface adapted to be oriented adjacent to and spaced apart from the recreational riding device. A support base is adapted to mate to the recreational riding device and defines a central axis, and a connecting element mates the base plate to the support base, and is adapted to allow pivotal movement, e.g., pitch and/or roll movement, of the base plate about the central axis with respect to the support base. The system can also include at least one compression member adapted to mate to at least one of the lower surface of the base plate and a recreational riding device. The compression member(s) are effective to compress between the base plate and the recreational riding device in response to a force applied to at least one of the base plate and the recreational riding device.

The connecting element can have a variety of configurations. In one embodiment, the connecting element is a support ring hingedly connected to the base plate to allow pivotal movement of the base plate thereabout. The support ring can be attached to the riding device via the support base. At an interface between the support ring and the base plate, the support ring can include at least one slot formed therein for receiving at least one corresponding pin member formed on the base plate. The slot(s) and pin member(s) are effective to provide a hinged connection between the base plate and the support ring. The system can also include cooperating surface features formed on an inner surface of the support ring and an outer surface of the support base to prevent rotational movement of the support ring with respect to the support base. The surface features can be, by way of non-limiting example, ridges, grooves, teeth, or combinations thereof.

In another embodiment, a binding support system is provided for mounting a rider's foot to a recreational riding device. The system includes a base plate having a first surface adjacent to and spaced apart from a surface of a recreational riding device, and a second surface adapted to support the rider's foot. At least one connecting element is adapted to connect the base plate to the recreational riding device such that the base plate is capable of pivotal movement about a fixed central axis. The system can also optionally include a support base having a first end adapted to mount upon the recreational riding device, and a second end adapted to be oriented adjacent the rider's foot. The support base defines the fixed central axis, which extends between the first and second ends of the support base. In use, the base plate includes a central opening adapted to surround the support base and the connecting element connects the base plate to the support base. The system can also optionally include at least one compression member adapted to compress between the base plate and the recreational riding device in response to a force applied to at least one of the base plate and the recreational riding device. The at least one compression member can be mated to at least one of the base plate and the recreational riding device.

In yet another embodiment, the connecting element can comprise a support ring having a first portion hingedly connected to the base plate to allow pivotal movement of the base plate, and a second portion mated to the support base. A ball-and-socket interface can be provided between the base plate and the support ring such that a peripheral portion of the support ring includes a convex protrusion that is matable within an inner, concave wall of the base plate that defines a central aperture of the base plate. The ball-and-socket interface is effective to allow pivotal movement of the base plate with respect to the support ring.

The present invention also provides a recreational riding device having an elongate board member with upper and lower surfaces, and at least one binding support component including a base plate having an upper surface configured to support a rider's foot, and a lower surface configured to be oriented adjacent to and spaced a distance apart from the elongate board member. A support base is removably mated to the elongate board member, and a connecting element is adapted to connect the base plate to the support base and to allow pivotal movement of the base plate about the central axis with respect to the elongate board. The device can also include at least one compression member adapted to compress between the base plate and the recreational riding device in response to a force applied to at least one of the base plate and the recreational riding device. The compression member is preferably mated to at least one of the base plate and the recreational riding device. In an exemplary embodiment, first, second, third, and fourth compression members are mated to a lower surface of the base plate. Each of the first, second, third, and fourth compression members can be spaced equidistantly from one another and from the central axis of the support base, or they can be spaced in any other desired arranged.

BRIEF DESCRIPTION OF THE DRAWINGS

The invention will be more fully understood from the following detailed description taken in conjunction with the accompanying drawings, in which.

DETAILED DESCRIPTION OF THE INVENTION

The present invention provides a binding system that is effective for use on a recreational device, such as a snowboard, and that is adapted to mate to, or that includes, a boot or other footwear worn by the user. In general, the binding system includes a base plate for supporting a rider's foot, and a connecting element for mating the base plate to an elongate board, e.g., a snowboard. The connecting element is effective to mate the base plate to a snowboard about a fixed central axis, yet to allow pivotal movement of the base plate about the central axis with respect to the snowboard thereby providing an adjustable suspension interface between the rider's foot and the snowboard. The term "pivotal," as used herein is intended to include pitch and roll movement, or some combination of pitch and roll movement, about a substantially fixed central axis. The binding system can also include at least one compression member mated to the base plate and/or to a snowboard. The compression member(s) are effective to compress between the base plate and the snowboard in response to a force applied to at least one of the base plate and the snowboard. The binding system is particularly advantageous in that the suspension interface between the base plate and the snowboard provides enhanced biomechanical operation and increasing mobility, and the compression members absorb chatter and shock. Moreover, there is no relative motion between the base plate and the boot since the system preferably pivots about a fixed central axis, so the rider's ability to control the snowboard is not adversely affected.

While the binding system 10 is described for use in connection with a snowboard 11, a person skilled in the art will appreciate that the binding system 10 can be used with a variety of recreational devices. Moreover, while a binding system 10 is described, a person skilled in the art will appreciate that the functionality or certain components of the binding system 10 can be built directly into a recreational riding device.

Figure 1:
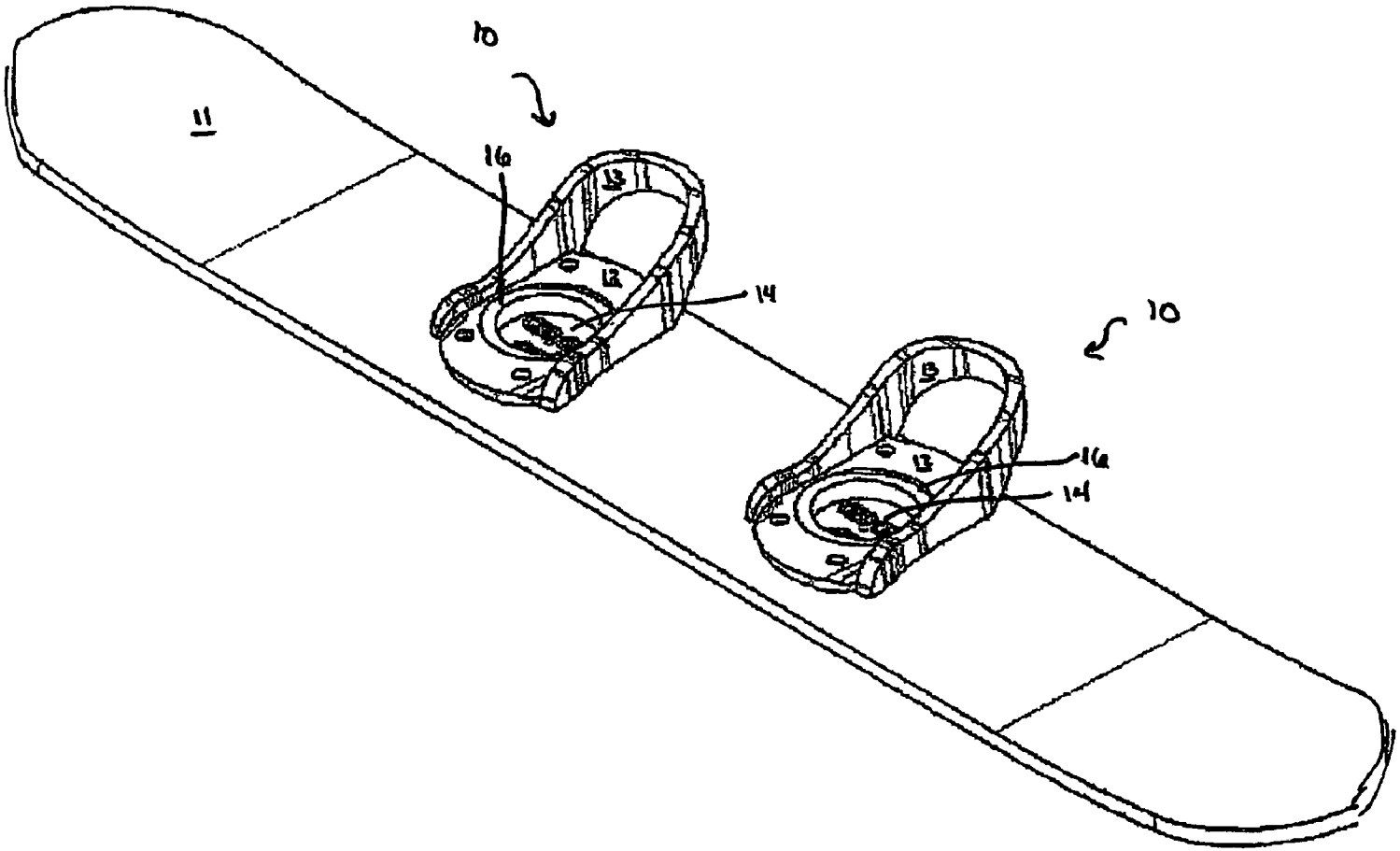
FIG. 1 is perspective view of a snowboard having two binding systems disposed thereon in accordance with the present invention.

FIG. 1 illustrates an exemplary embodiment of a snowboard 11 having two snowboard binding systems 10 mounted thereon. Each binding system 10 is substantially identical, and thus the same reference numbers are used to refer to corresponding parts. As shown, each binding system 10 includes a base plate 12 having a strap member 13 extending around a portion of the outer periphery of the base plate 12. A connecting element 16, which is mated to the snowboard 11 via a support base or clamp 14, is coupled to the base plate 12 to allow pivotal movement of the base plate 12 with respect to the connecting element 16. The connecting element 16 and the support base 14 are also effective to position the base plate 12 at a distance apart from the snowboard 11 to allow pivotal movement of the base plate 12, and thereby provide an adjustable suspension interface. Each binding system 10 also includes at least one compression member 24, 26, 28, 30 (FIG. 3C) disposed between a lower surface of the base plate 12 and the snowboard 11. The compression members absorb chatter and shock, as well as dampen and restrict the overall pivotal movement of the base plate 12 to provide enhanced biomechanical operation of the snowboard 11.

Figure 2:
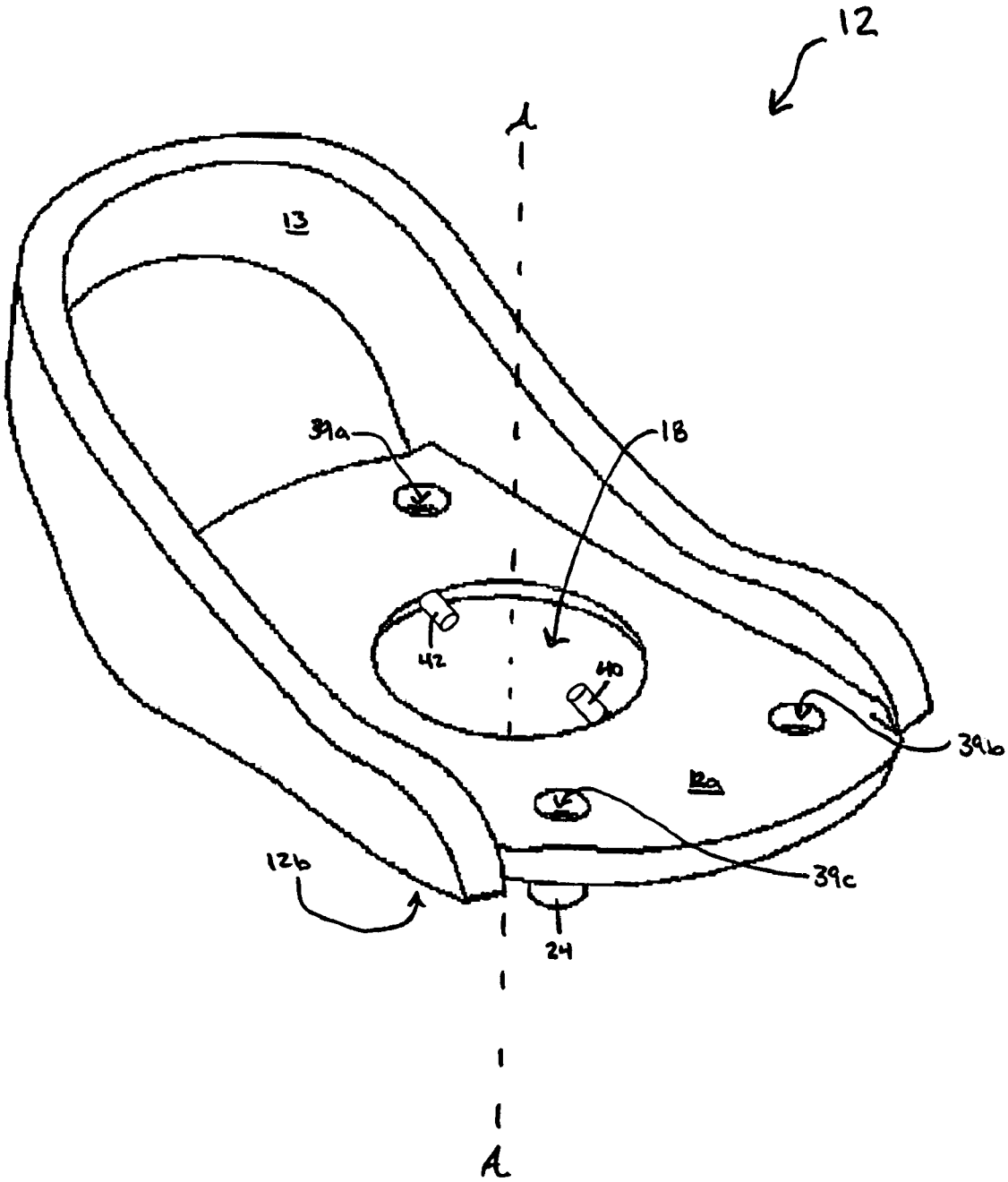
FIG. 2 is a perspective view of the base plate portion of one of the binding systems shown in FIG. 1.

FIG. 2 illustrates the base plate 12 portion of a binding system 10 in more detail. The base plate 12 can have virtually any shape and size, but is preferably adapted to support a rider's foot. As shown in FIG. 2, the base plate 12 has a substantially rectangular shape and includes upper and lower surfaces 12*a*, 12*b*. The upper surface 12*a* is adapted to support a rider's foot, and the lower surface 12*b* is adapted to be disposed adjacent to, but positioned a distance apart from, the upper surface of a snowboard 11. The base plate 12 can also be adapted to mate to a boot or other footwear worn by a rider, and thus can include one or more binding elements formed thereon or mated thereto. As shown in FIGS. 1 and 2, a strap 13 is attached to opposed longitudinal sides of the base plate 12, and is adapted to extend around the ankle of a rider's foot. While straps 13 are shown, a person skilled in the art will appreciate that a variety of techniques can be used for mating the base plate 12 to a rider's foot, and that the illustrated strap 13 is merely one technique. Other suitable binding elements include buckles, metal fasteners, step-in bindings, and any other binding known in the art.

The base plate 12 is further adapted to mate to a snowboard 11 in a manner in which the base plate 12 is preferably non-rotatable, yet is pivotally movable about a central axis A. The central axis A can be positioned at a variety of locations, but is preferably positioned at a substantial midpoint of a rider's foot. In order to allow such movement, the base plate 12 is configured to couple to a connecting element 16 that is effective to position the base plate 12 at a distance apart from the upper surface of the snowboard 11, and that is effective to allow the desired pivotal movement of the base plate 12. As shown in FIG. 2, the base plate 12 includes a central opening 18 formed preferably at about a midpoint thereof for receiving a connecting element. Virtually any connecting element can be used to achieve this effect, including, for example, ball-and-socket type connections. Moreover, the connecting element can be formed integrally with the base plate 12, or it can be a separate component having one or more parts. The location of attachment of the connecting element to the base plate 12 can also vary, and is not limited to being positioned within a central opening 18.

Figure 3A:
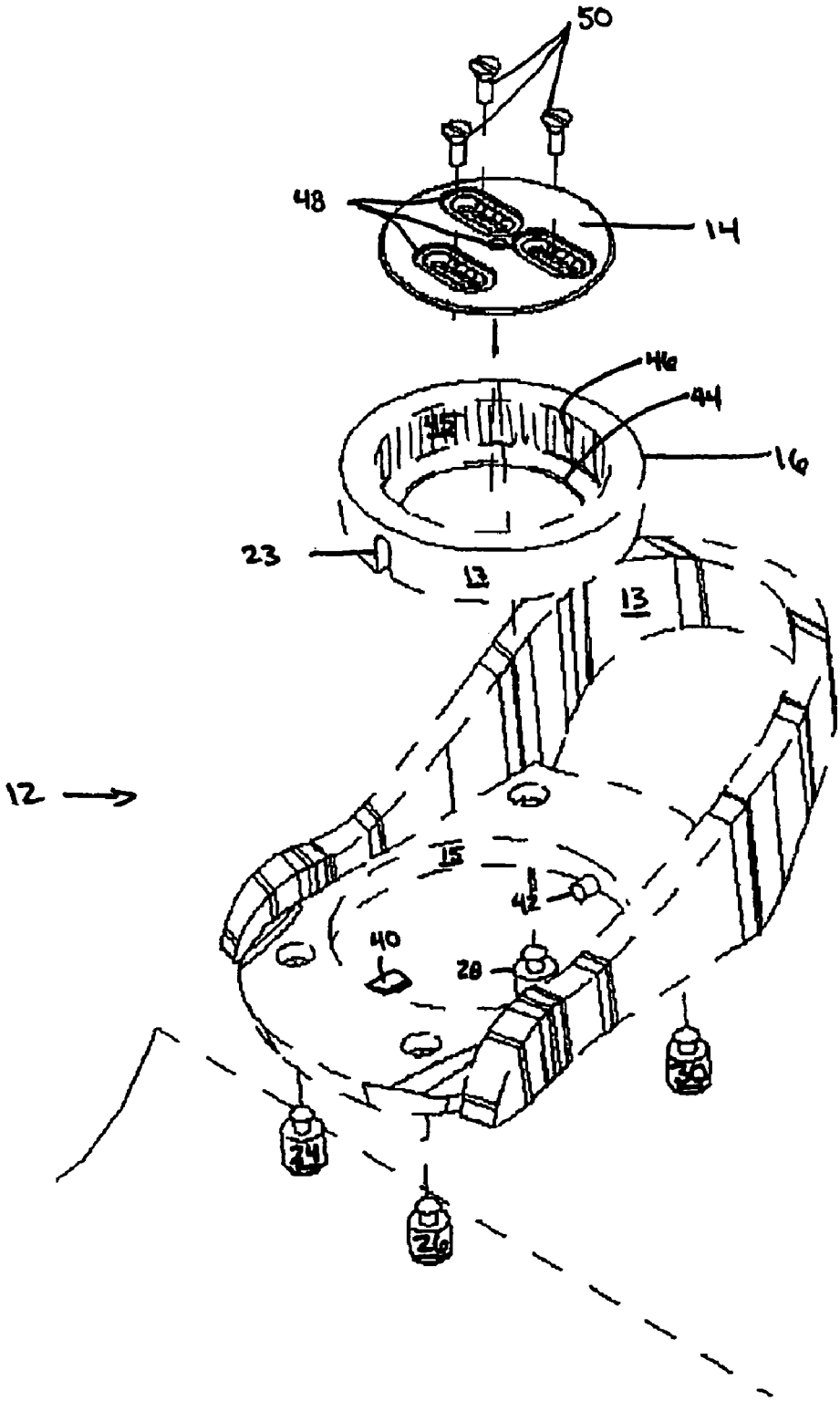
FIG. 3A is a perspective view of a binding system in the disassembled state in accordance with one embodiment of the present invention.
Figure 3B:
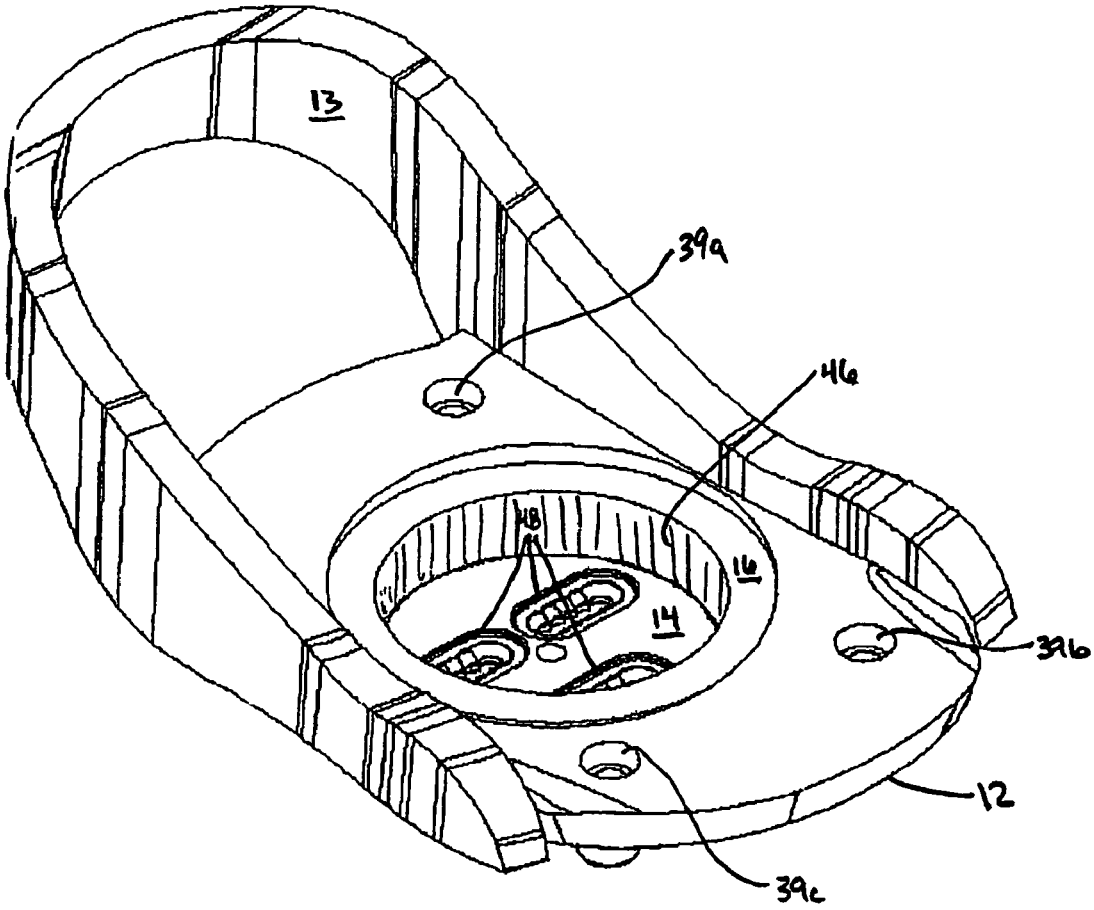
FIG. 3B is a perspective view of the binding system shown in FIG. 3A in the assembled stated.
Figure 3C:
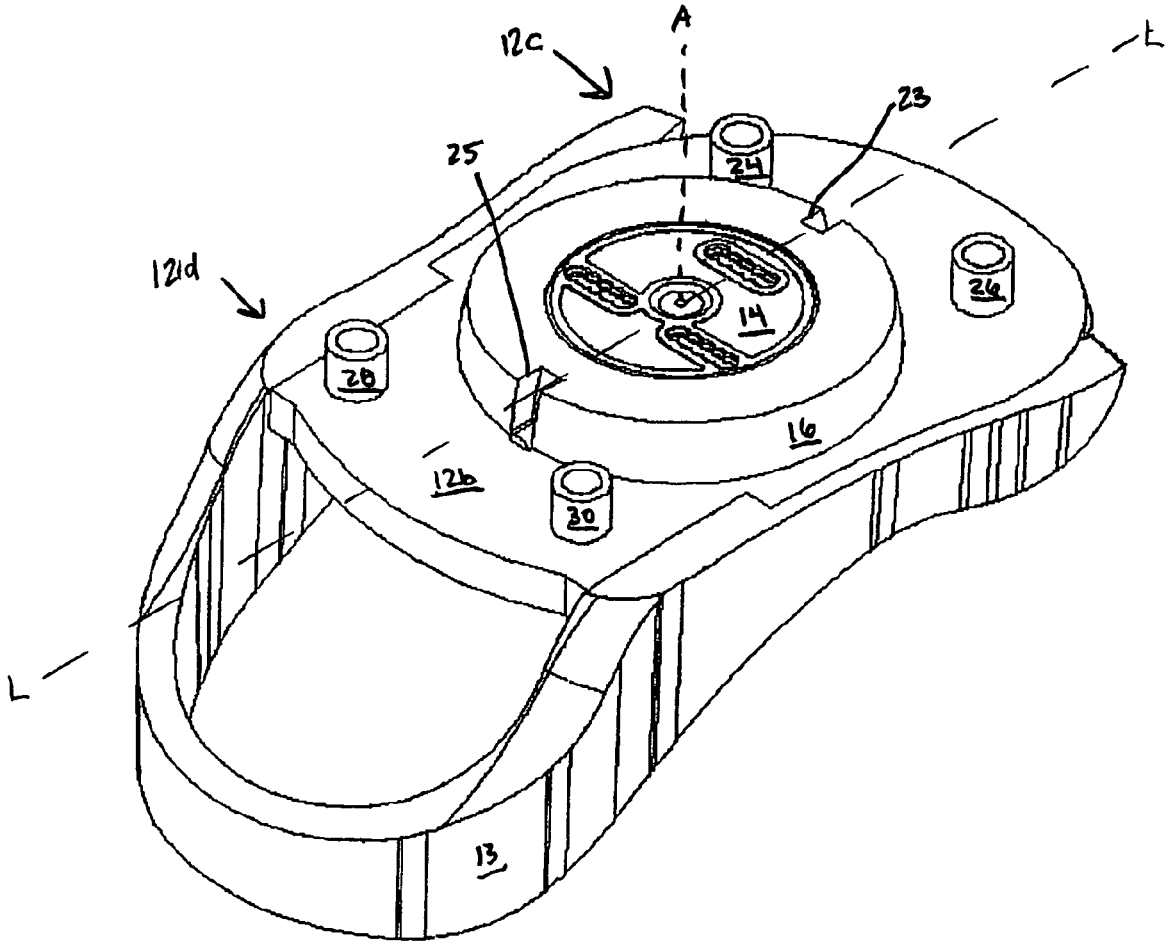
FIG. 3C is a perspective, bottom view of the binding system shown in FIG. 3B.

While a variety of techniques can be used to pivotally mate the base plate 12 to the snowboard 11, FIGS. 3A-3C illustrate an exemplary embodiment of a connecting element having a support ring 16 which can be mated to a snowboard using a support base or support ring clamp 14. The support ring 16 is adapted to be pivotally disposed within the central opening 18 (FIG. 2), and the support ring clamp 14 is effective to mate the support ring 16 to the snowboard 11.

The support ring 16 can have a variety of configurations, but is preferably a ring-shaped member having an outer surface 17 and an opposed inner surface 45 with a flange 44 formed around a bottom periphery thereof. The outer surface 17 is configured to interface with the inner surface 15 of the base plate 12, and thus each surface 15, 17 can optionally be complimentary to one another. By way of non-limiting example, the outer surface 17 of the support ring 16 can be convex (not shown) and the inner surface 15 of the base plate 12 can be concave (not shown) to facilitate pivotal movement of the base plate 12 about the support member 16.

While the base plate 12 is pivotally movable about the support ring 16, the system 10 preferably includes an anti-rotation mechanism that is effective to prevent rotational movement of the base plate 12. A variety of anti-rotational mechanisms can be used. In a preferred embodiment, either the base plate 12 or the support ring 16 can include one or more slots 20, 22 that are effective to receive corresponding pin members formed on the other one of the base plate 12 and the support ring 16. As shown in FIGS. 2, 3A, and 3C, the base plate 12 includes opposed pin members 40, 42 that are adapted to be disposed within corresponding slots 23, 25 (FIG. 3C) formed on outer periphery of the support ring 16. The pin members 40, 32 prevent rotational movement, yet allow pivotal movement, of the base plate 12 with respect to the support ring 16. The slots 23, 25 and pin members 40, 42 can be disposed at any position on the base plate 12 and support ring 16, but are preferably aligned along a longitudinal axis L (FIG. 3C) to allow side-to-side pivotal movement, as well as front-to-back movement.

Still referring to FIGS. 3A-3C, the inner surface 45 of the support ring 16 is adapted to seat the support ring clamp 14. While several different types of support ring clamps 14 are known in the art, in this embodiment, the support ring 16 includes a flange 44 formed around the lower inner edge thereof for seating the support ring clamp 14. Preferably, the inner surface 45 of the support ring 16 just above the flange 44 includes surface features, e.g., ridges or grooves 46, to mate with corresponding surface features (not shown) formed on an outer periphery of the support ring clamp 14. The surface features prevent rotational movement of the support ring 16 with respect to the support ring clamp 14, and also allow the base plate 12 to be positioned on the snowboard 11 at a desired angle relative to the longitudinal axis of the snowboard 11. A person skilled in the art will appreciate that, while surface features are shown, a variety of other techniques can be used to prevent rotation of the support ring 16 with respect to the support ring clamp 14.

The support ring clamp 14 can also be a cylindrical member that includes one or more openings 48 extending therethrough for receiving a fastening element, such as a screw 50. Each opening 48 can optionally be elongated and can include a scalloped perimeter defining multiple seating positions for the fasting element 50. A person skilled in the art will appreciate that a variety of clamp members can be used to mate the support ring 16 to a snowboard 11, and that the illustrated support ring clamp 14 is merely one embodiment.

In use, the support ring 16 is positioned within the central opening 18 of the base plate 12, and the base plate 12 and support ring 16 are then positioned at the desired angle on the snowboard 11. The support ring clamp 14 is then placed into the support ring 16 such that the openings 48 are in alignment with corresponding fastener-receiving members, e.g., screw bores, formed on the snowboard 11. The fastening elements, e.g., screws 50, are then inserted through the openings 48 and threaded into the corresponding screw bores (not shown) in the snowboard 11 to secure the support ring clamp 14 to the snowboard 11, and thereby position the support ring member 16 and base plate 12 at a desired orientation. The base plate 12 is then free to pivot with respect to the support ring 16, thereby enhancing the biomechanical operation of the snowboard 11. In particular, the pivotal motion reduces stress on the rider's feet and legs, and provides the rider with a more responsive, more stable, and easier to control snowboard 11.

As noted above, the binding system 10 can also include one or more compression members effective to dampen and restrict the overall pivotal motion of the base plate 12 and to receive compressive forces placed on the base plate 12 by the rider. The system 10 can include any number of compression members, and each compression member can mate to either the base plate 12 and/or the snowboard 11. Alternatively, the compression members can be incorporated into footwear to be worn by a user. Moreover, the compression members can be molded into the base plate 12 of binding 10, fit as an after-market attachment, housed within the snowboard 11, or they can be incorporated into a step-in system in the same fashion.

In an exemplary embodiment, as shown in FIG. 3C, the compression members 24, 26, 28, 30 are mated to a lower surface 12*b* of the base plate 12. While the compression members 24, 26, 28, 30 can be positioned anywhere on the base plate 12, the compression members 24, 26, 28, 30 are preferably positioned to restrict the pitch and roll pivoting motion of a rider's foot. More particularly, two compression members 24, 26 are preferably spaced apart from one another and positioned along a proximal end 12*c* of the base plate 12, and the remaining two compression members 28, 30 are spaced apart from one another and positioned along a distal end 12*d* of the base plate 12. The compression members can optionally be positioned equidistant from one another and/or from the central axis A. In use, each compression member 24, 26, 28, 30 is adapted to compress in response to a force applied to the base plate 12 and/or snowboard 11 during use.

Each compression member 24, 26, 28, 30 can have a variety of shapes, sizes, and configurations, and can be formed from a variety of materials. By way of non-limiting example, each compression member can be in the form of a spring or other compressible material, such as an elastomeric polymer. Alternatively, one or more of the compression members 24, 26, 28, 30 can be formed from a rigid, non-compressible material to allow the user to selectively prevent pivotal motion in one or more directions. Each compression member can also optionally be adjustable and/or removable. By way of non-limiting example, the compression members can have an adjustable height to allow the user to adjust the desired angle of leg canting and stiffness or compressive properties as desired.

Figure 4A:
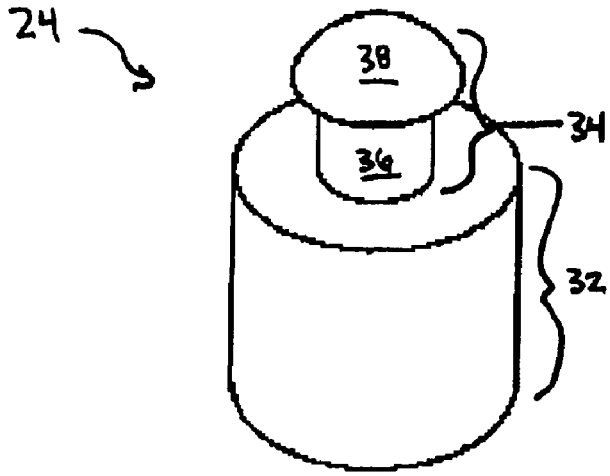
FIG. 4A is a perspective side view of one embodiment of a compression member for use with a binding system according to the present invention.
Figure 4B:
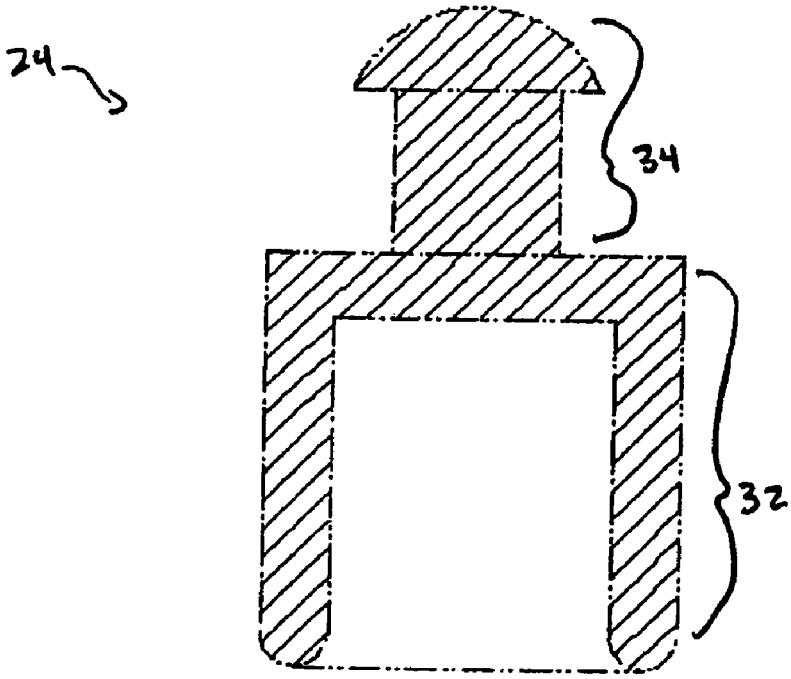
FIG. 4B is a cross-sectional view of the compression member shown in FIG. 4A.

FIGS. 4A-4B illustrate an exemplary embodiment of a compression member 24 in more detail. As shown, the compression member 24 has a generally cylindrical body 32 with a mating element 34 formed on a proximal end thereof. The body 32 can be solid, but is preferably hollow and is formed from an elastomeric material, such as rubber, to provide the desired compressive properties during use of the system 10. The mating element 34, which preferably mates the compression member 24 to the base plate 12, includes a shaft 36 with a hemispherical head 38 formed thereon. In use, the head 38 is inserted through an opening, e.g., opening 39*a* shown in FIG. 3B, formed in the base plate 12. As shown in FIGS. 2 and 3B, the base plate 12 includes four openings 39*a*, 39*b*, 39*c*, only three of which are illustrated, that are adapted to receive compression members 24, 26, 28, 30. For reference purposes, only opening 39*a*, which receives compression member 24, will be described in connection with compression member 24. The opening 39*a* preferably has a diameter smaller than a diameter of the hemispherical head 38 to allow the head 38 to be compressed during insertion through the opening in the base plate 12, and to return to its original state when it is fully inserted through the opening 39*a* to engage the base plate 12 and prevent removal of the compression member 24. This embodiment of the mating element 34 is particularly advantageous in that it allows the compression member 24 to be easily replaced. A person skilled in the art will appreciate that virtually any mating technique can be used to removably and/or permanently mate the compression members to the base plate 12 and/or the snowboard 11. Other suitable mating techniques include, for example, a threaded engagement, a snap-fit connection, and other mechanical mating techniques. The compression members 24, 26, 28, 30 can alternatively be fixedly attached to or formed integrally with the base plate 12 and/or the snowboard 11.

In another embodiment, the binding system 10 can include a locking feature to prevent pivotal movement in a particular direction. This is particularly advantageous in that it allows the user to adjust or prevent the pivoting motion as desired. While a variety of techniques can be used to control the pivotal motion of the base plate 12, in an exemplary embodiment the system 10 and/or the snowboard 11 include one or more locking members (not shown) that are adapted to be disposed between the base plate 12 and the snowboard 11 to prevent movement of the base plate 12 with respect to the snowboard 11 in the particular location of the locking member. The locking members can have a variety of configurations, but they are preferably similar to the compression members 24, 26, 28, 30, except that they are formed from a non-compressible material. Each locking member can be mated to the base plate 12, for example, by replacing one or more of the compression members 24, 26, 28, 30. Alternatively, the base plate 12, or the snowboard 11, can include an opening (not shown), similar to opening 39*a* shown in FIG. 3B, for removably receiving the locking element. In an exemplary embodiment, the base plate 12 and/or the snowboard 11 include a first opening positioned between the front openings 39*b* and 39*c* formed in the base plate 12, and a second opening positioned between the rear openings 39*a*, 39*d* formed in the base plate 12. The location of the first and second openings, in use, is effective to prevent pitch motion (i.e. heel-toe motion). A person skilled in the art will appreciate that a variety of other techniques can be used to lock the base plate 12 with respect to the snowboard 11.

Figure 5:
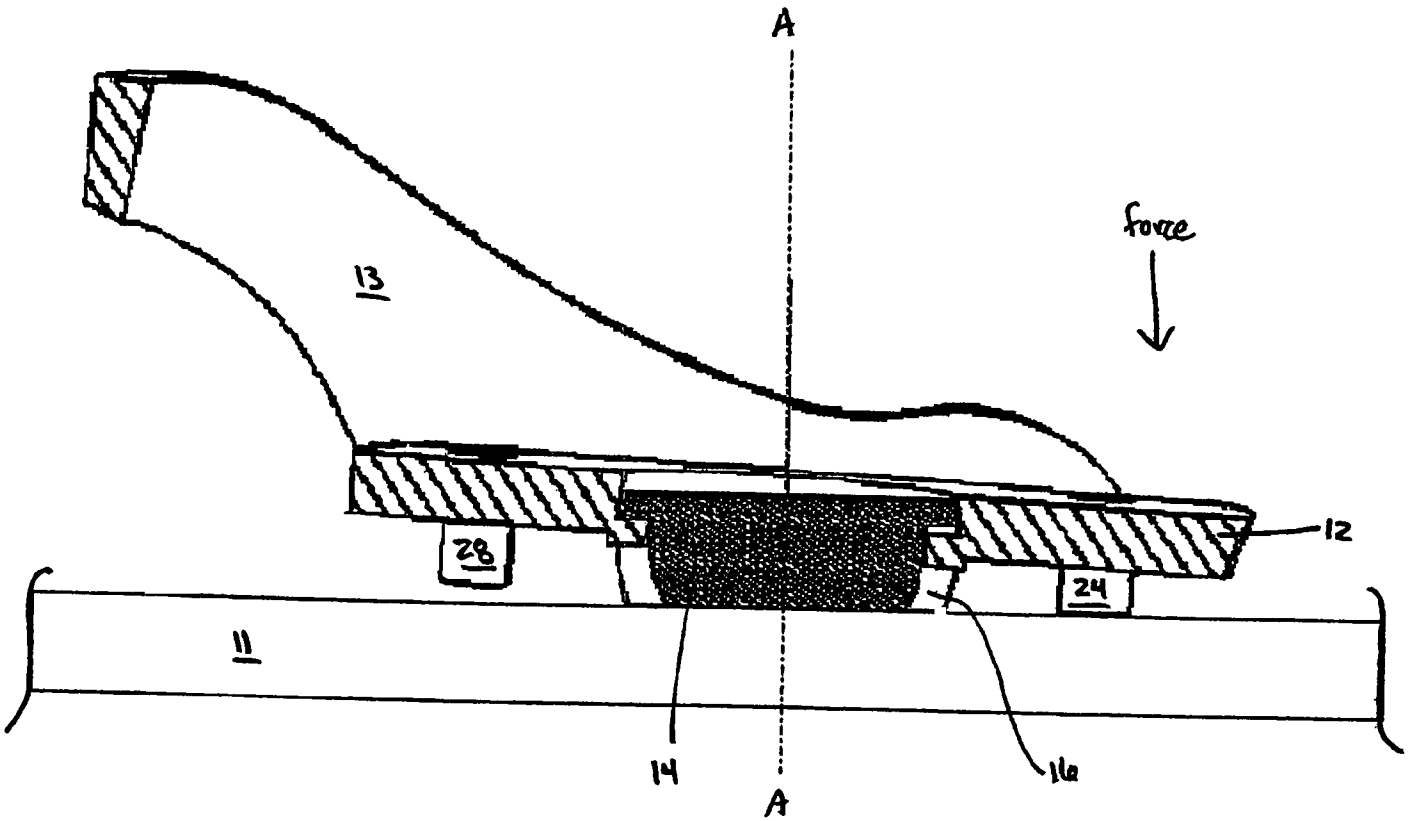
FIG. 5 is a cross-sectional side view of the binding system shown in FIGS. 3B and 3C.

FIG. 5 illustrates a cross-sectional view of the binding system 10 in the fully assembled state and attached to a snowboard 11. As shown, application of a force by a rider will cause the binding system 10 to pivot with respect to the axis A, thereby applying a force onto one or more of the compression members 24, 26, 28, 30. In FIG. 5, the compression members 24, 26 disposed adjacent the rider's toes are being compressed, while the rear compression members 28, 30 are spaced apart from the snowboard 11. Again, this is particularly advantageous in that it allows the rider to more accurately control the snowboard and it provides biomechanical stability. The compression members are also advantageous in that they reduce stress placed on the rider's feet and legs, and they absorb chatter and shock.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A binding support system for mounting a rider's foot to a recreational riding device, the binding support system comprising:

a base plate having a first surface adjacent to and spaced apart from a surface of a recreational riding device, a second surface adapted to support the rider's foot and defining a longitudinal axis extending through the base plate;

a support base having a first end adapted to mount upon the recreational riding device and a second end adapted to be oriented adjacent the rider's foot and having a fixed central axis extending between the first and second ends of the support base, wherein the base plate includes a central opening adapted to surround the support base and the connecting element is adapted to connect the base plate to the support base, and at least one connecting element adapted to connect the base plate to the recreational riding device such that the base plate is allowed to rotate, with respect to the support base, about the longitudinal axis extending through the base plate and also allow rotation of the support base about a pitch axis extending normal to the longitudinal axis and normal to the fixed central axis, the connecting element comprises a support ring connected to the base plate to prevent rotational movement of the base plate with respect to the support ring, and a second portion mated to the support base, and a peripheral portion of the support ring is convex and interfaces with an inner, concave wall of the base plate that defines a central aperture of the base plate, the interface being effective to allow pivotal movement of the base plate with respect to the support ring.

* * * * *